US010000263B2

(12) United States Patent
Farber et al.

(10) Patent No.: US 10,000,263 B2
(45) Date of Patent: Jun. 19, 2018

(54) UNDERWATER SYSTEM AND METHOD

(71) Applicant: Elta Systems Ltd., Ashdod (IL)

(72) Inventors: Amit Farber, Rosh Ha'ayin (IL); Ehud Erell, Herzliya (IL)

(73) Assignee: Elta Systems Ltd., Ashdod (IL)

( * ) Notice: Subject to any disclaimer, the term of this patent is extended or adjusted under 35 U.S.C. 154(b) by 0 days. days.

(21) Appl. No.: 15/025,708

(22) PCT Filed: Sep. 29, 2014

(86) PCT No.: PCT/IL2014/050855
§ 371 (c)(1),
(2) Date: Mar. 29, 2016

(87) PCT Pub. No.: WO2015/049678
PCT Pub. Date: Apr. 9, 2015

(65) Prior Publication Data

US 2016/0244135 A1 Aug. 25, 2016

(30) Foreign Application Priority Data

Oct. 1, 2013 (IL) ..... 228660

(51) Int. Cl.
*B63G 8/14* (2006.01)
*B63G 7/02* (2006.01)
(Continued)

(52) U.S. Cl.
CPC ..... *B63G 7/02* (2013.01); *B63G 8/001* (2013.01); *B63B 2702/12* (2013.01); *B63G 2007/005* (2013.01); *B63G 2008/004* (2013.01)

(58) Field of Classification Search
CPC ..... B63G 7/02; B63G 8/001
See application file for complete search history.

(56) References Cited

U.S. PATENT DOCUMENTS 3,880,103 A 4/1975 Talkington
5,370,074 A 12/1994 Knudsen et al.
(Continued)

FOREIGN PATENT DOCUMENTS

CA 2770247 A1 9/2013
EP 1147045 A1 10/2001
(Continued)

OTHER PUBLICATIONS

Supplementary European Search Report for European Application 14850897 (May 24, 2017).

*Primary Examiner* — Stephen P Avila
(74) *Attorney, Agent, or Firm* — Mintz Levin Cohn Ferris Glovsky and Popeo, P.C.; Steven M. Jensen

(57) ABSTRACT

Systems and methods are provided for underwater use. In one example the system includes an autonomous mother unmanned underwater vehicle (AMUV) and one or more auxiliary unmanned underwater vehicles (UUV). The AMUV is configured for autonomously searching for and detecting undersea objects potentially present in an undersea region of interest (ROI), for generating object information relating to the objects detected thereby to enable identification of at least one object of interest (OOI) among the detected objects, and for selectively transporting the UUV to at least within a predetermined distance from a location of the OOI. The UUV is configured for interacting with the OOI at least within the predetermined distance. Such a system is further configured for providing verification information indicative of the interaction between the UUV and the OOI. The AMUV includes a communications system at least configured for transmitting at one or both of the verification information and the object information.

24 Claims, 4 Drawing Sheets

(51) Int. Cl.

| | |
|---|---|
| ***B63G 8/00*** | (2006.01) |
| *B63G 7/00* | (2006.01) |

(56) References Cited

U.S. PATENT DOCUMENTS

| | | | |
|---|---|---|---|
| 6,854,410 | B1 | 2/2005 | King et al. |
| 7,530,316 | B2 | 5/2009 | Blohm et al. |
| 2008/0087186 | A1 | 4/2008 | Blohm et al. |
| 2012/0048171 | A1 | 3/2012 | Kalwa |
| 2012/0055390 | A1 | 3/2012 | Kalwa et al. |

FOREIGN PATENT DOCUMENTS

| | | | |
|---|---|---|---|
| EP | 2489588 | B1 | 4/2016 |
| GB | 2482576 | A | 2/2012 |
| WO | 03/045776 | A1 | 6/2003 |
| WO | 2012/013171 | A1 | 2/2012 |

UNDERWATER SYSTEM AND METHOD

TECHNOLOGICAL FIELD

The presently disclosed subject matter relates to systems and methods for underwater use, in particular for hunting and neutralization of mines.

PRIOR ART

References considered to be relevant as background to the presently disclosed subject matter are listed below:

U.S. Pat. No. 7,530,316
GB 2,482,576
EP 2489588
EP1147045
US 2012/0055390
US 2012/0048171

Acknowledgement of the above references herein is not to be inferred as meaning that these are in any way relevant to the patentability of the presently disclosed subject matter.

BACKGROUND

Underwater vehicles have a variety of uses, including for example mine hunting.

For example, U.S. Pat. No. 7,530,316 discloses a method for detection and neutralization of underwater objects which are present in a sea region, in particular mines. A two-dimensional or three-dimensional image of the seabed is created by means of an unmanned first underwater vehicle during a reconnaissance mission in a sea region section by means of optical and/or acoustic sensors, and this image is evaluated for the presence of underwater objects, after completion of the reconnaissance mission. At least one underwater object which is present is marked in the image, and the image which has been provided with the object marking is stored in an unmanned second underwater vehicle, which is equipped with the same sensors and additionally with a neutralization unit. During a neutralization mission by the second underwater vehicle in the same sea region section, image elements of the seabed are created continuously by means of the sensors and are compared with the stored image of the seabed. The second underwater vehicle is guided to the marked underwater object on the basis of the comparison data, and activates the neutralization unit there.

For example, GB 2,482,576 relates to a weapon clearance appliance for clearing weapons, such as underwater mines or munitions which have been sunk in waterways, under water by detonation of the weapon. In this case, the weapon clearance appliance is provided with means for detachable connection to an unmanned underwater vehicle, so that the underwater vehicle is a safe distance away when the weapon is detonated. In order to allow the use of conventional small underwater vehicles, the volume of the weapon clearance appliance is chosen such that the buoyancy force which acts on the weapon clearance appliance under water compensates for the force of gravity acting on the weapon clearance appliance. Therefore, the weapon clearance appliance has neutral buoyancy, as a result of which, after the weapon clearance appliance has been released from the underwater vehicle, there is no need to retrim the underwater vehicle. There is therefore no need for trimming devices on the underwater vehicle. The reference also relates to an underwater vehicle having a weapon clearance appliance of this kind, and to a method for clearing weapons using a weapon clearance appliance of this kind.

For example, US 2012/0048171 relates to an unmanned underwater vehicle having at least one sensor unit which can be used to acquire sensor information relating to objects in the area surrounding the underwater vehicle. The reference also relates to a method for operating the unmanned underwater vehicle. In order to sense structures and contours of objects under water, the reference provides for the at least one sensor unit to be arranged such that it can be moved in a tangential direction of the underwater vehicle, that is to say tangentially with respect to the longitudinal axis of the underwater vehicle or an axis running parallel to the longitudinal axis, and can be positioned in the circumferential direction by a positioning device to which the sensor information can be specified.

For example, US 2012/0055390 relates to an unmanned underwater vehicle which can be controlled according to predefinable control information by means of a control device. The reference also relates to a method for operating an unmanned underwater vehicle. To reduce the outlay for investigations of underwater areas using unmanned underwater vehicles, the reference provides for the underwater vehicle to be able to be controlled either in an autonomous operating mode or in a remotely controlled operating mode, predetermined internal control information from a memory element being able to be predefined to the control device in the autonomous operating mode and external control information being able to be predefined to the control device via a communication device of the underwater vehicle in the remotely controlled operating mode.

GENERAL DESCRIPTION

According to at least a first aspect of the presently disclosed subject matter, there is provided a system for underwater use, comprising:

- an autonomous mother unmanned underwater vehicle (AMUV) and at least one auxiliary unmanned underwater vehicle (UUV),
  - the AMUV being configured for autonomously searching for and detecting undersea objects potentially present in an undersea region of interest (ROI), for generating object information relating to the objects detected thereby to enable identification of at least one object of interest (OOI) among the detected objects, and for selectively transporting said at least one UUV to at least within a predetermined distance from a location of said at least one OOI;
  - said at least one UUV being configured for interacting with said at least one OOI at least within said predetermined distance;
- the system being further configured for providing verification information indicative of said interaction between said at least one UUV and said OOI;
- wherein said AMUV comprises a communications system at least configured for transmitting at least one of said verification information and said object information.

For example, said at least one UUV is configured for interacting with said at least one OOI according to predetermined parameters at least within said predetermined distance. For example, the OOI is a mine and said interaction comprises neutralizing the mine. For example, said neutralization comprises destroying the mine or causing the mine to detonate.

For example, said AMUV is configured for autonomously identifying at least one said OOI among the detected objects in said ROI by processing said object information. For example, said processing of said object information comprises comparing a geometrical form of the respective object with a geometrical forms corresponding to the OOI. For example said AMUV comprises imaging sensors configured for providing image data representative of said geometrical form of the respective object. For example, said imaging sensor includes at least one of optical sensors and acoustic sensors.

Additionally or alternatively, for example, said AMUV comprises a propulsion system, a maneuvering system and a navigation system coupled to a control unit for enable autonomous operation of said AMUV.

Additionally or alternatively, for example, said transmitted object information is processed remotely from said system, and wherein said communication system is configured for receiving control information verifying that a respective said object has been identified by the AMUV is OOI.

Additionally or alternatively, for example, said transmitted object information is processed remotely from said system, and wherein said communication system is configured for receiving control information indicative that a respective said object has been identified remotely as being an OOI.

Additionally or alternatively, for example, said verification information comprises imaging data of the respective said location subsequent to said interaction with the respective said OOI.

Additionally or alternatively, for example, said communication system comprises an antenna that is selectively deployable above the water surface for operation above the water surface while the AMUV is submerged.

Additionally or alternatively, for example, said communication system is configured for transmitting and receiving data using at least one of the following types of communication:

cellular communication systems;

satellite telephone communication systems;

satellite communication systems using broadband.

Additionally or alternatively, for example, said system is configured for selectively engaging said at least one UUV to said AMUV at least while being transported by said AMUV, and for selectively disengaging said at least one UUV from said AMUV within said predetermined distance from the OOI.

Additionally or alternatively, for example, said at least one UUV is a self-propelled remotely operated vehicle and is controlled by said AMUV. For example, said at least one UUV is connected to said AMUV via an umbilical tether.

Additionally or alternatively, for example, said at least one UUV is a self-propelled autonomous vehicle and is configured for operating autonomously at least when interacting with said at least one OOI within said predetermined distance.

Additionally or alternatively, for example, said at least one UUV is a non-self-propelled vehicle and is configured for being deposited within said predetermined distance at least when interacting with said at least one OOI.

Additionally or alternatively, for example, said at least one UUV comprises an explosive charge configured for being selectively detonated in a manner to neutralize the respective OOI.

Additionally or alternatively, for example, said AMUV is configured for autonomously travelling to the ROI from a starting point remote from said ROI.

Additionally or alternatively, for example, said AMUV is configured for autonomously detecting said undersea objects present in an undersea region of interest, by providing detection information for each detected said object relating to a characteristic of said objects.

Additionally or alternatively, for example, said AMUV is configured for providing homing information regarding said location of a respective OOI to said at least one UUV, and wherein said at least one UUV is configured for homing onto said location based on said homing information.

Additionally or alternatively, for example, said AMUV comprises a ballast system configured for selectively enabling the system to bottom out. For example, said AMUV comprises a ballast system configured for selectively and repeatably enabling the system to bottom out. For example, said control unit is configured for causing the system to bottom out for a predefined period.

According to at least a second aspect of the presently disclosed subject matter, there is also provided a system for underwater use, comprising:

an autonomous mother unmanned underwater vehicle (AMUV), configured for autonomously searching for and detecting undersea objects present in an undersea region of interest, for providing detection information for each detected said object relating to a characteristic of said objects, and for providing homing information regarding a respective location of at least one object of interest (OOI) among said objects;

at least one auxiliary unmanned underwater vehicle (UUV) configured for homing onto and neutralizing said at least one OOI based on said homing information;

wherein said system is configured:

for providing said homing information from the AMUV to a respective said UUV, for selectively transporting the respective said UUV via said AMUV, and for selectively releasing the respective UUV from the AMUV when said OOI has been identified, to selectively allow the UUV to home onto and neutralize said at least one OOI; and for subsequently providing verification information indicative that said OOI has been neutralized;

wherein said AMUV comprises a communications system for communicating with a central control and configured for sending and/or receiving signals or data above the water surface, for at least one of:

transmitting said verification information;

transmitting object information relating to said objects to the central control.

For example, the communication system is configured for transmitting said verification information, and wherein said AMUV is further configured for autonomously identifying said OOI according to predetermined criteria. For example, transmitting said object information to the central control enables the central control to identify said OOI or to confirm identification of said OOI by said AMUV according to predetermined criteria.

According to at least a third aspect of the presently disclosed subject matter, there is provided a method for underwater use, comprising:

providing a system for underwater use, as defined herein, in particular above regarding the first aspect or the second aspect of the presently disclosed subject matter;

operating the system to interact with said at least one OOI within said predetermined distance.

According to at least a fourth aspect of the presently disclosed subject matter, there is provided a method for underwater use, comprising:

providing an autonomous mother unmanned underwater vehicle (AMUV) and at least one auxiliary unmanned underwater vehicle (UUV);

operating the AMUV for autonomously searching for and detecting undersea objects potentially present in an undersea region of interest (ROI);

identifying at least one object of interest (OOI) among the detected objects, and selectively transporting said at least one UUV to at least within a predetermined distance from a location of said at least one OOI;

causing said at least one UUV to interact with said at least one OOI at least within said predetermined distance;

providing verification information indicative of said interaction between said at least one UUV and said OOI;

transmitting at least one of said verification information and said object information.

For example, said at least one UUV is configured for interacting with said at least one OOI according to predetermined parameters at least within said predetermined distance. For example, the OOI is a mine and said interaction comprises neutralizing the mine. For example, said neutralization comprises destroying the mine or causing the mine to detonate.

For example, said AMUV autonomously identifies at least one said OOI among the detected objects in said ROI by processing said object information. For example, said processing of said object information comprises comparing a geometrical form of the respective object with a geometrical forms corresponding to the OOI. For example, said geometrical form of the respective object is provided by image data of the respective object. For example, said imaging data includes at least one of optical image data and acoustic data.

Additionally or alternatively, for example, the method comprises the step of processing said transmitted object information remotely from said AMUV, and the step of receiving control information verifying that a respective said object that has been identified by the AMUV is OOI.

Additionally or alternatively, for example, the method comprises the step of processing said transmitted object information remotely from said AMUV, and comprising the step of receiving control information by the AMUV indicative that a respective said object has been identified remotely as being an OOI.

Additionally or alternatively, for example, said verification information comprises imaging data of the respective said location subsequent to said interaction with the respective said OOI.

Additionally or alternatively, for example, the method comprises causing the AMUV to selectively deploy an antenna above the water surface for operation above the water surface to transmit at least one of said verification information and said object information while the AMUV is submerged. For example, the method comprises transmitting and receiving data using said antenna via at least one of the following types of communication:

cellular communication systems;

satellite telephone communication systems;

satellite communication systems using broadband.

Additionally or alternatively, for example, the method comprises selectively engaging said at least one UUV to said AMUV at least while being transported by said AMUV, and selectively disengaging said at least one UUV from said AMUV within said predetermined distance from the OOI.

Additionally or alternatively, for example, the method comprises remotely operating said at least one UUV by said AMUV or autonomously operating said at least one UUV at least when interacting with said at least one OOI within said predetermined distance.

Additionally or alternatively, for example, the method comprises causing the AMUV to autonomously travel to the ROI from a starting point remote from said ROI, while the at least one UUV is engaged to the AMUV.

Additionally or alternatively, for example, the method comprises autonomously detecting said undersea objects present in an undersea region of interest, via the AMUV, by providing detection information for each detected said object relating to a characteristic of said objects.

Additionally or alternatively, for example, the method comprises providing homing information regarding said location of a respective OOI to said at least one UUV by the AMUV, and causing said at least one UUV to home onto said location based on said homing information.

Additionally or alternatively, for example, the method comprises selectively causing the AMUV to bottom out.

Additionally or alternatively, for example, the method comprises selectively causing the AMUV to bottom out repeatedly.

Additionally or alternatively, for example, the method comprises selectively causing the AMUV to bottom out for a predefined period.

A feature of at least some examples of the presently disclosed subject matter is that the system can search for and neutralize mines, offensively or defensively, in a manner that does not endanger personnel.

Another feature of at least some examples of the presently disclosed subject matter is that the system can search for and neutralize mines in a covert manner.

Another feature of at least some examples of the presently disclosed subject matter is that the system can search for and neutralize mines in an autonomous or semi autonomous manner.

Another feature of at least some examples of the presently disclosed subject matter is that the system can transmit and/or receive data, including object data, verification data, and command information, from a remote central control before, during or after a mission for search for and neutralization of mines.

BRIEF DESCRIPTION OF THE DRAWINGS

In order to better understand the subject matter that is disclosed herein and to exemplify how it may be carried out in practice, several examples will now be described, by way of non-limiting examples only, with reference to the accompanying drawings, in which.

DETAILED DESCRIPTION OF THE FIGURES

Figure 1:
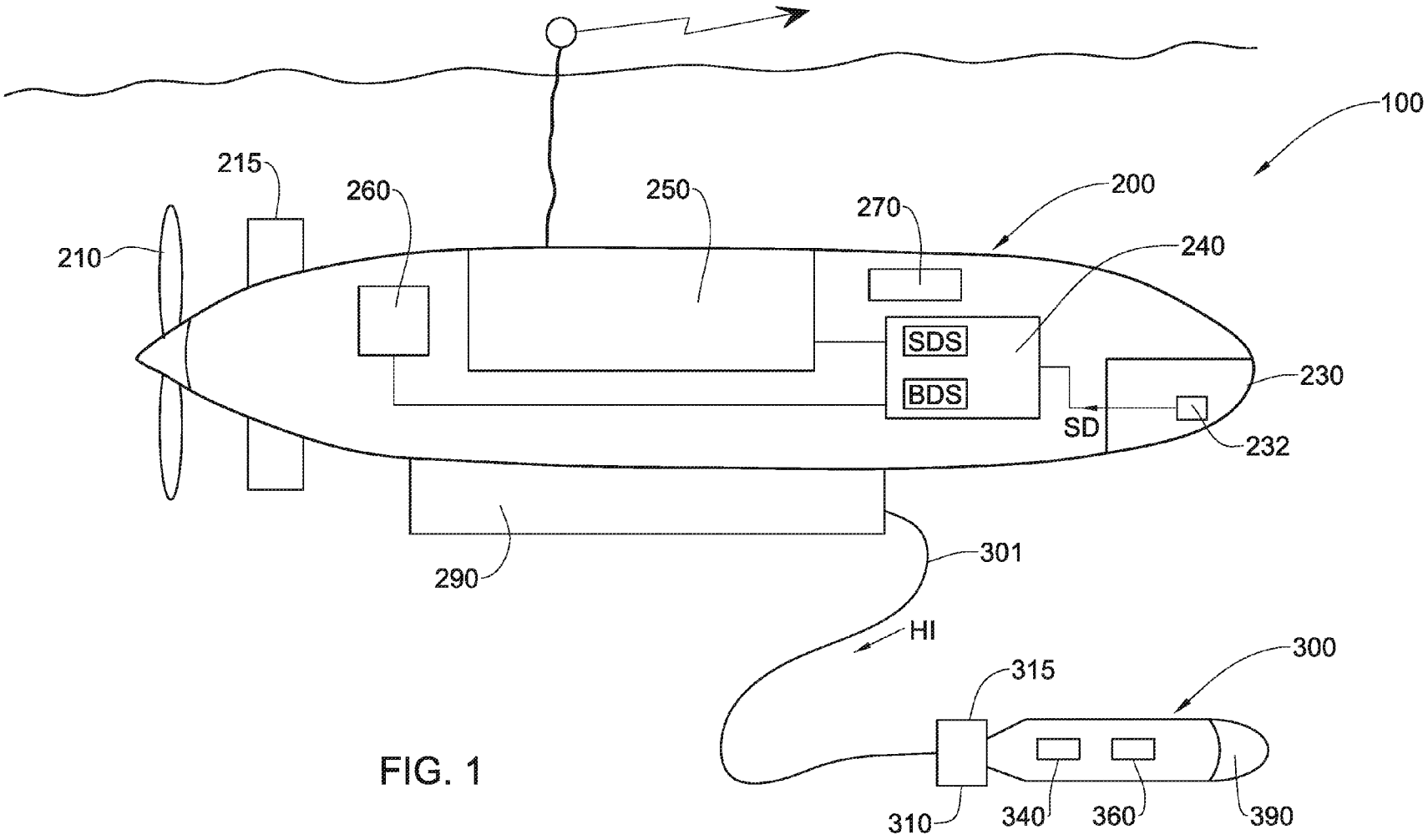
FIG. 1 is a schematic representation illustrating in side view a system for underwater use according to one example of the presently disclosed subject matter.

Referring to FIG. 1, a system for underwater use according to a first example of the presently disclosed subject matter is generally designated with reference numeral 100, and comprises an autonomous unmanned underwater vehicle (AMUV) 200 (also referred to interchangeably herein as an autonomous main unmanned underwater vehicle, or, as an autonomous mother unmanned underwater vehicle, or, as a main unmanned underwater vehicle, or, as a mother unmanned underwater vehicle), and at least one other unmanned underwater vehicle (UUV) 300 (also referred to herein as an auxiliary unmanned underwater vehicle).

In the illustrated example, the system 100 is particularly configured for use in hunting and disabling undersea mines (also referred to interchangeably herein as mines), providing, in at least some examples of the presently disclosed subject matter, one or more of the functions of: searching for, detecting, identifying, and neutralizing mines, as well as providing verification of such neutralization. However, the skilled practitioner appreciates that at least some examples of the presently disclosed subject matter or variations thereof are also applicable, mutatis mutandis, to other types of underwater activity, including for example one or more of the following: hunting for and retrieval of objects from the sea bed or close thereto; for installation of undersea devices at or near the seabed, for example acoustic or surveying devices for seabed survey, or listening devices; for surveying or checking pipelines or communication lines; miscellaneous underwater operations that include delivery of objects to or retrieval of objects from the seabed or close thereto.

Figure 2:
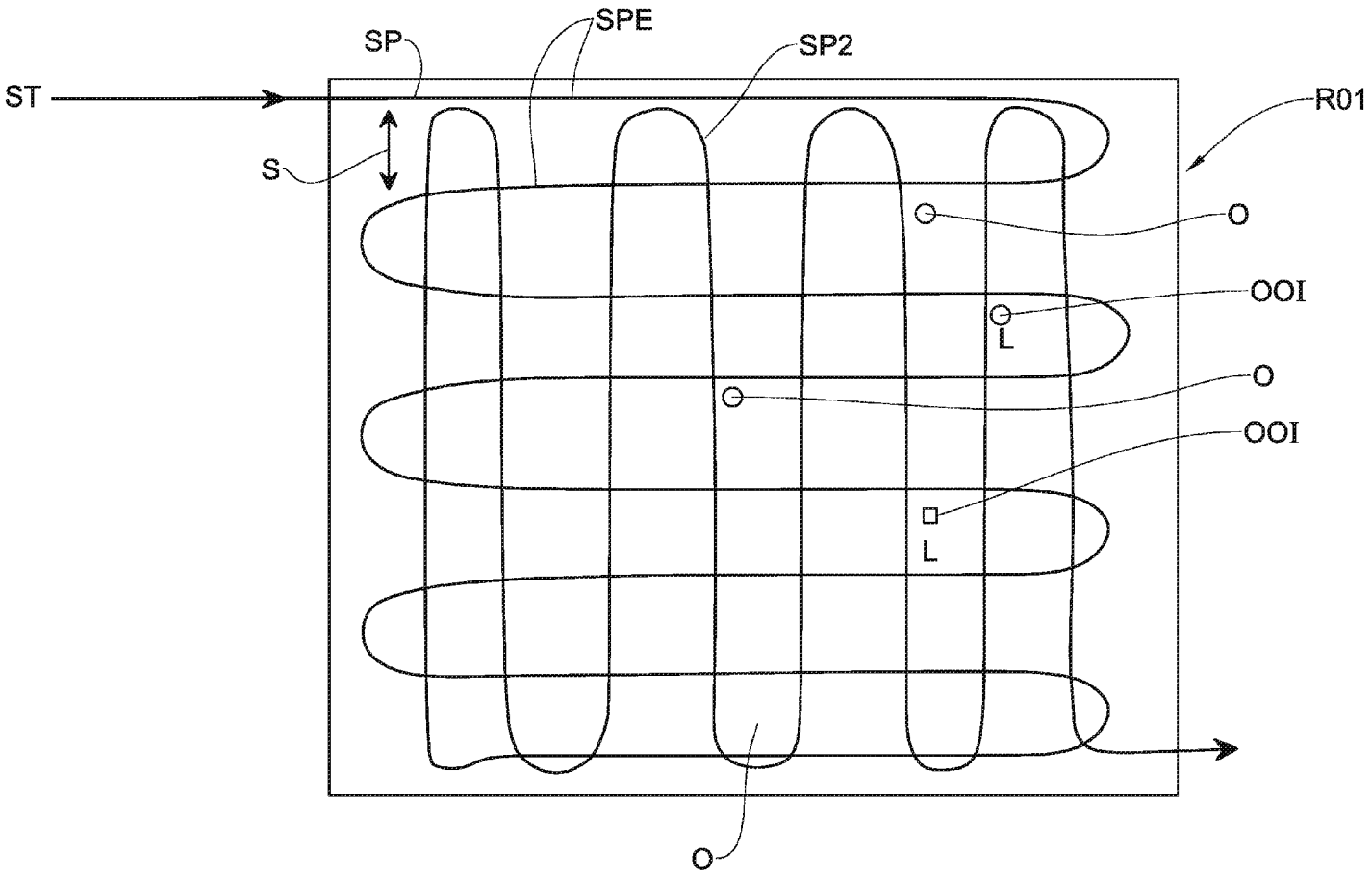
FIG. 2 is a schematic representation illustrating possible coarse search patterns for the example of FIG. 1.

Referring also to FIG. 2, the AMUV 200 is configured for autonomously searching for and at least detecting undersea objects O (also referred to interchangeably herein as an object) present in an undersea region of interest ROI, while the AMUV 200 is submerged. The term undersea herein includes any body of water, natural or man-made, including for example a sea, ocean, lake, river, reservoir, and so on.

The AMUV 200 is also configured for providing detection information DI for each detected object O. The detection information DI includes information that indicates that an object O has been detected at a particular location L, and in at least some examples the detection information DI relates to at least one characteristic M of these objects O. In at least some variations of this example, the detection information DI may also include identification data relating to the object O, identifying the object as an object of interest OOI, such as for example a mine. The AMUV 200 is also configured for providing homing information HI regarding the respective location L of at least one object of interest OOI among these objects O.

Referring again to FIG. 1, the AMUV 200 comprises a hull 201, in this example a pressure resistant hull, is self-propelled, and is configured for operating autonomously.

The hull 201 in this example is made from materials that minimize acoustic signature, for example carbon fiber or fiberglass, rending the AMUV 200 less detectable by an enemy active sonar. In this example, the hull 201 of the AMUV 200 is in the form of a generally torpedo-shaped body, with a streamlined nose and streamlined tail (including a propeller), and a mid-section of generally uniform cross-section. In this example, the AMUV 200 does not include a vertical structure amid-ships, commonly referred to as a "sail" or "fin". In alternative variations of this example, the hull can have a different form, and optionally can include such a vertical structure. In this example, the AMUV 200 is about 10 m long, with a diameter of about 1.2 m along the mid-section, and can have a weight of about 6 tonnes, though in alternative variations of this example, and in other examples, the AMUV can different dimensions and/or different weight.

In this example, the AMUV 200 includes a number of operating devices in or on the hull 201, including: a power supply, an underwater propulsion system 210; a steering and/or maneuvering capability including maneuvering units such as for example vectorable maneuvering thrusters and/or control vanes schematically illustrated at 215; a suitable sensor package 230; a control unit 240; a navigation system 260; and a communication system 250.

In this example, the AMUV 200 includes a ballast system 270 for selectively changing the depth of the AMUV 200 independently of the propulsion system 210 or of the maneuvering units 215.

The ballast system 270 also allows the system 100, in particular the AMUV 200, to bottom out when desired, i.e., to rest on the seabed. This feature allows the system 100 to be deployed to the ROI or close thereto (and "parked" thereat on the seabed) a period of time before the system is actually needed, and thus to have the system 100 in place even before there is a direct need to use the system for searching an neutralizing mines, for example. In such cases, the control unit 240 can be programmed, for example, to search the ROI periodically, for example once a day, starting at a particular date—till then, the system 100 can operate in sleep mode or standby mode to conserve power. Alternatively, the control unit 240 can be programmed, for example, to check at the end of a particular period of time, for example after a few days or a week, whether the time has come to initiate a search and neutralization mission, and for this purpose the ballast system can bring the system 100 near to the water surface, and the communication system 250 is then able to receive transmissions from the central control that instruct the system 100 to return to bottom out mode for another period of time, or to begin a search and neutralization mission, either immediately, or after a period of time, or in response to a particular change in circumstances—for example if the sensor package 230 detects a particular "ping" sequence than can be transmitted to it by the users of the system 100 for example. This feature of bottoming out can thus provide the system 100 with an effective long endurance capability by allowing conservation of power until the system is needed.

The navigation system 260 is operatively connected to the control unit 240, and provides navigation data to the control unit, which then controls the propulsion system 210 and the maneuvering units 215 to autonomously navigate the system 100 from its starting point ST to the undersea region of interest ROI. For example, the starting point ST can be a carrier ship from which the system is launched, or at the perimeter of or within the region of interest ROI—for example the system 100 can be parachuted to the sea directly at a desired geographical location corresponding to the region of interest ROI. Thereafter the system 100 can operate autonomously for searching, etc. The navigation system 260 typically comprises an inertial navigation system (INS) and can include a receiver for receiving position data from a suitable global navigation satellite positioning system, for example GPS, EU Galileo, Compass navigation system, GLONASS. The control system 240 comprises a suitable computer system, and is provided with suitable programming instructions to cause the system 100, inter alia, to travel autonomously to the desired undersea region of interest ROI.

Referring again to FIG. 2, once the system 100 is at the undersea region of interest ROI, the system 100 is capable of, and is correspondingly programmed to, autonomously initiate and manage a search procedure of the undersea region of interest ROI for objects O. For this purpose the control system 240 controls the propulsion system 210 and the maneuvering units 215 to cause the system 100 to follow a particular search pattern within the undersea region of interest ROI. For example, such a search pattern can include paths that enable the system 100 to cover the whole of the undersea region of interest ROI within a desired degree of resolution. The control system 240 can include a number of alternative search patterns stored in a memory, and can choose between the various search patterns according to predetermined criteria, including for example, one or more of: sea depth, sea state, currents, presence of hostile shipping at or near the undersea region of interest ROI, presence of hostile detection systems in the undersea region of interest ROI. For example, if the system 100 is configured for detecting the presence of hostile detection systems in the undersea region of interest ROI, for example by detecting the ping of an enemy active sonar, the search pattern may include an element of randomness, and perhaps take longer, than an alternative search pattern where no such presence is detected and in which the search pattern may be more predictable in nature.

Referring again to FIG. 2, one search pattern can include an undulating search path SP including a plurality of juxtaposed search path elements spaced by a spacing S. In at least some examples, the searching is based on sonar data provided by sonar sensors in the sensor package 230. For example, the sensors can be distributed over the hull 201. The detection rage of sonar typically depends on water quality, temperature, sea state, salinity, water density, and the detection range in turn determines spacing S between the parallel search paths elements SPE to provide the aforementioned degree of resolution.

In some examples, the sonar sensors are located on the sides of the hull 201 in a "look-down" configuration, and can possibly result in dead zones being formed immediately below the AMUV 200 in which no sonar data is generated. In such cases, the search pattern can include a second undulating search path SP2, that crosses or criss-crosses the first undulating search path SP. The geometry of a number of standard search paths can be programmed into the AMUV 200, in particular the control unit 240, and the exact particulars of a specific search path (for example spacing S, forward velocity of the system 100), can be based on such standard search paths and autonomously adjusted to take account of the detection rage of sonar and other parameters, including for example the size and shape of the region of interest ROI.

While travelling along the paths of the search pattern, the system 100, and in particular the UMAV 200, is configured for providing a search function for objects O using the sensor package 230.

The sensor package 230 comprises one or more sensors 232 that are configured for at least detecting an object O, via the aforementioned at least one characteristic M of an object O, and in particular for detecting at least one characteristic M of an object of interest OOI among said objects O.

Typically, the sensor resolution of each sensor 232 is smaller than the size of the searched-for object of interest OOI, for example one or several orders of magnitude smaller than the size of the searched-for object of interest OOI.

In the present example, such an object of interest OOI is a sea mine (also referred to herein as a mine), although in alternative variations of this example and in other examples, the object of interest OOI can be an object that is not a mine.

Figure 3:
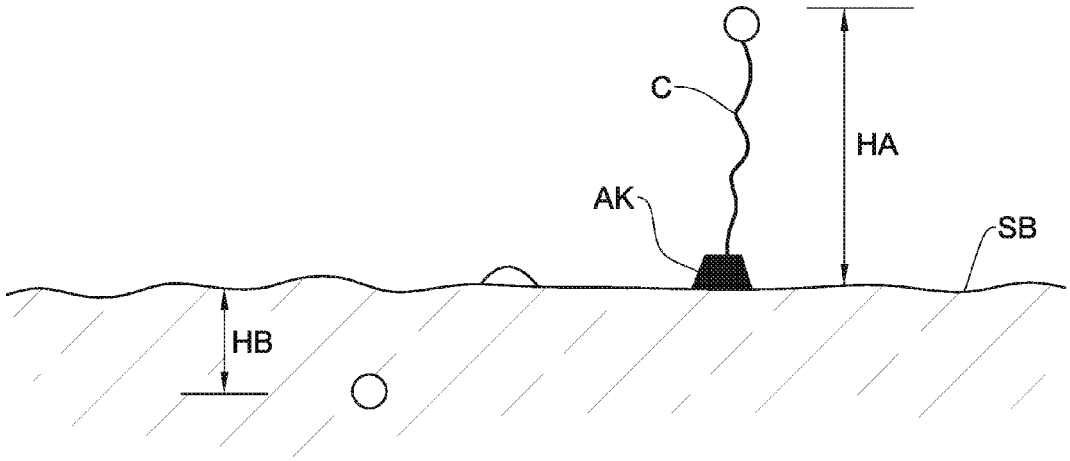
FIG. 3 is a schematic representation illustrating possible depths for locations of mines.

Such a mine is typically configured to detonate in response to the proximity of a large sea vessel, and/or in response to a particular underwater noise signature that is associated with some types of sea vessels (for example war ships, or troop carrier ships, or cargo ships), and/or is configured as a magnetic mine. Referring also to FIG. 3, such mines can be located on the sea bed SB, or can be partially buried or fully buried up to a predetermined depth HB below the sea bed SB, or can be suspended via an anchoring cable C up to a predetermined height HA above the sea bed SB. Thus, the undersea region of interest ROI can include an area over the sea bed SB, and optionally extend upwards to a height HA or greater above the sea bed SB, and can optionally extend to a predetermined bed depth HB or greater below the sea bed SB.

Furthermore, such mines often have a particular geometric form, for example a particular 3D geometry or even a particular 2D geometry (e.g., when viewed as a 2D image), which is readily recognizable. In such cases, the aforementioned characteristic M can relate to, and thus include, a geometric indicator in the form of the aforesaid geometric form of the object of interest OOI.

Thus, in this example, and referring to FIG. 1 and FIG. 3, the sensor package includes at least one sensor 232 capable of scanning the sea bed SB, and/or at least up to a predetermined bed depth HB below the sea bed SB where such mines can possibly be buried but still hazardous, and/or at least up to a predetermined height HA above the sea bed SB where such mines can be suspended from an anchor AK via anchoring cable C.

For example, such sensors 232 can include one or more optical and/or acoustic sensors. Such optical sensors can include, for example, a high resolution camera operating in the visible spectrum, and/or in the IR spectrum and/or in the UV spectrum to obtain optical image data of the undersea region of interest ROI, and in particular of the objects O therein. Such acoustic sensors can include, for example, short-range sonar, or synthetic aperture sonar (SAS), which can provide sonar image data of the undersea region of interest ROI, and in particular of the objects O therein. Additionally or alternatively, the sensors 232 can include a parametric sonar or a sediment echo sounder which can provide image data of the seabed characteristic of the seabed SB to a depth corresponding to the penetration depth of the sensor. The various types of image data provided by the sensor package 230 are collectively referred to herein as sensor data SD.

Thus, such sensors 232 can thus provide 2D or 3D image data of the topology of the undersea region of interest ROI, including the objects O that happen to be therein, whether such objects O are on the seabed surface itself, or suspended above the seabed surface, or buried beneath the seabed surface.

As already mentioned, the AMUV 200 is configured for providing detection information DI for each detected object O, in which the detection information DI relates to at least one characteristic M of these objects O. In this example, the AMUV 200 provides the detection information DI as follows. The sensor package 230 provides sensor data SD to the control unit 240, which in this example is programmed to autonomously detect the objects O based on the sensor data SD. The control unit 240 in this example detects the objects O via suitable change detection algorithms. Such algorithms are based on providing a baseline data set BDS representative of the topology of the undersea region of interest ROI, at a particular moment in time $T_0$, in which it is known (or at least there is a sufficiently high level of probability) that the undersea region of interest ROI does not contain any objects of interest OOI. Such a topological baseline data set BDS can be stored in a memory in the control unit 240 or operatively connected thereto, for example. Then, each subsequent autonomous search at a time $T_n$ after time $T_0$, of the same undersea region of interest ROI, by system 100 to detect objects O therein generates a respective subsequent data set SDS representative of the topology of the undersea region of interest ROI at that time $T_n$. The subsequent data set SDS can be compared with baseline data set BDS by the control unit 240, and any differences between the two data sets, corresponding to respective changes in the topology of the undersea region of interest ROI, are identified via the control unit 240 as a "topological artifact" for further processing. Each such difference between the data sets is typically in the form of a change in the local topology of the undersea region of interest ROI, and the sensor data relating to each such change in local topology is referred to herein as data ΔDS.

In the above example, in which the aforesaid characteristic M is the geometric or topological form of the object O, this further processing includes evaluating whether each such data ΔDS relating to the topological artifact corresponding to the change in the local topology of the undersea region of interest ROI is significant, and could potentially correspond to an object O, or whether such data ΔDS is not of significance. For example, the data ΔDS for each such change in topology can be analyzed to determine the size of the topological artifact corresponding to data ΔDS, and this particular data ΔDS can be discarded if at least one dimension thereof (of the length, breadth or width dimensions of the topological artifact, for example) is too large or too small to correspond to an object of interest OOI. For example, this particular data ΔDS can be discarded if at least one dimension thereof is less than a preset threshold. Such a threshold can be, for example, less than 70% or some other percentage of a corresponding dimension of the smallest object of interest OOI that the system 100 is searching for. On the other hand, for each change in the local topology of the undersea region of interest ROI that is deemed significant, the respective topological artifact is classified as an object O, and data regarding the location L thereof is noted by the control, unit 240.

The detection information DI for each detected object O comprises the respective data ΔDS, to which can be added the data relating to location L of the object O. The data relating to the location L can include, for example, the global coordinates of the location, for example longitude and latitude, as well as the depth below the sea surface, plus optionally an indicator to indicate whether the respective data ΔDS relates to a topological artifact that is on the sea bed, or that is buried in the sea bed, or that is suspended above the seabed. Alternatively, the data relating to the location L can include, for example, the distance and direction to the location L from a particular geographical location, plus optionally an indicator to indicate whether the respective data ΔDS relates to a topological artifact that is on the sea bed, or that is buried in the sea bed, or that is suspended above the seabed.

Figure 4:
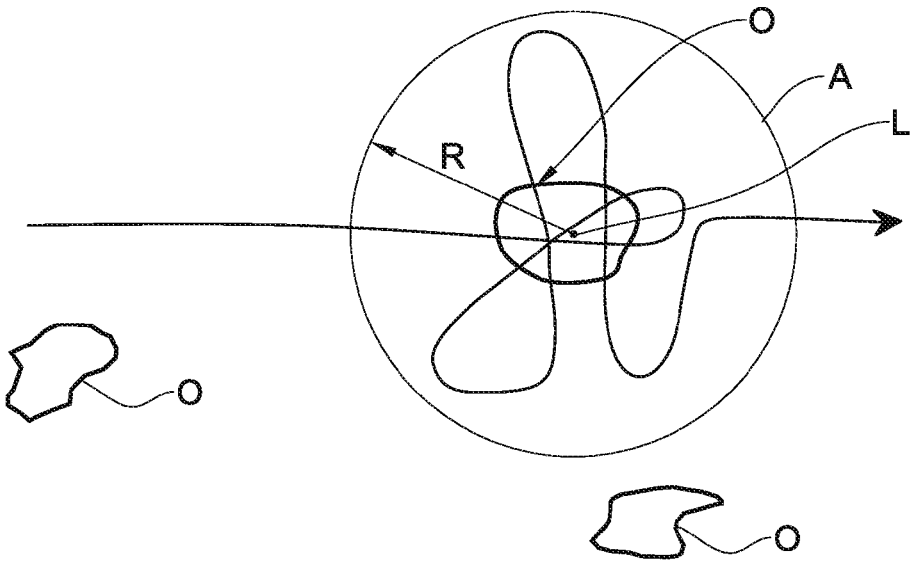
FIG. 4 is a schematic representation illustrating possible fine search patterns for the example of FIG. 1

Optionally, and referring to FIG. 4, the AMUV 200 can be further configured for carrying out at each such location L an autonomous detailed scan of a zone A (including an area of the seabed SB or a volume including this area plus a region above and/or below this area) generally centered at the location L, and up to a radius R thereof greater than the corresponding largest dimension of the largest OOI that the system 100 is searching for. Such a scan can include a specialized search pattern within this area A to provide additional data of the topology thereof, thereby providing more accurate data in the respective detection information DI.

The UMAV 200 is further configured, in this example, for autonomously identifying any objects of interest OOI among the objects O, according to predetermined criteria. In this example, the detection information DI corresponds to, or at least includes, topological information of an artifact. In such cases, the predetermined criteria can include whether the shape and size of the topological artifact corresponding to the respective object O is sufficiently similar to that of the type of object of interest being searched for. For example, the control unit 240 comprises a memory containing a plurality of data packages, each including data or other information relating to the shape and/or size of a particular type of object of interest OOI, for example covering a variety of known undersea mines. The control unit 240 compares the size and/or shape of the object O, corresponding to each particular detection information DI, with all the data packages in the memory, to obtain a match. Such a match can be a perfect match, or can be a partial match. For example, the control unit 240 can determine that the size and/or shape of one particular detection information DI are greater than 50%, say 70% or 80% or 90%, of the size and/or shape of one particular known mine, and thus there is a relatively high probability that the respective object O is indeed an object of interest OOI in the form of this particular known mine. Thus, the control unit 240 can directly identify an object of interest OOI at the detection stage of the respective object O.

Alternatively or additionally, the control unit 240 is configured for transmitting, using the communication system 250, the detection information DI and location L of each object O to a manned or autonomous central control, remote from the system 100, to enable the central control to identify any OOI among the objects O, according to the aforesaid or other predetermined criteria.

Alternatively or additionally, the control unit 240 is configured for transmitting, using the communication system 250, the detection information DI and location L of each object of interest OOI that has been identified thereby to a manned or autonomous central control, remote from the system 100, to enable the central control to verify correct identification by the system 100 (in particular of the control unit 240) of the object of interest OOI among the objects O.

The sensor package 230 comprises, in this example, obstacle avoidance sonar for collision free navigation, facilitating autonomous steering of the system 100, particularly the AMUV 200, if obstacles, large or small, are encountered. Such obstacle avoidance sonar are well known in the art.

The communication system 250 is configured for selectively deploying, and optionally selectively retracting, an above-surface antenna at least while the UMAV 200 is submerged.

The communication system 250 is configured for selectively transmitting and/or receiving data (including command information) when the antenna is deployed. Optionally, such data (including command information) can be encrypted.

Alternatively, the communication system 250 can include a balloon that is selectively inflatable to float on the water surface or to become lighter than air and thus float in the air above the water surface, and in any case carries a communications antenna. Such a balloon is tethered to the UMAV 200 via a communications cable (e.g. a fiber optic cable or electrical cable) connected to transmission/receiver equipment in the UMAV 200. After use, the balloon can be discarded or destroyed (for example the UMAV 200 can comprise a plurality of such balloons), or can be selectively deflated and retracted back into the UMAV 200 using suitable retracting equipment, or example a winch and reel to reel in the tether.

In any case, the communication system 250 is configured for providing at least one, and preferably more than one, type of communication, for example one or more of the following:

Cellular communication systems—for example via existing cellular networks, for example when the system 100, in particular the AMUV 200 is located near a cellular communications tower.

Satellite telephone communication systems, for example IRIDIUM.

Satellite communication systems using broadband—for example such a broadband communication system can be configured for massive data exchange, for example allowing for transmission of sensor data from the system 100, and for receiving mission data from the central control. For example, such mission data can include an updated list of desired objects of interest OOI, including their characteristics M, and/or can include an updated map of the—region of interest ROI, and/or can link the system 100, in particular the AMUV 200, with any external database, which can be updated in real time.

In alternative variations of this example and in other examples, the characteristic M can include other, non-geometric indicators—for example the object of interest OOI may be known to transmit electromagnetic radiation of a certain wavelength, or to be leaking a chemical or radiation, or to be hotter or colder than the surrounding marine environment. In such cases, the sensor package 230 includes sensors 232 capable of detecting such indicators, and for identifying the location of the indicators, and in this manner detect the objects O and their locations, and possibly also identify the objects as the searched-for objects of interest OOI.

Once an object of interest OOI has been identified, either autonomously by the UMAV 200, or via the central control, the location L thereof is noted by the control unit 240, which then provides homing information HI for enabling the UUV 300 to enable the UUV 300 to home into this location from any one of a variety of locations in which the UMAV 200 may find itself. This homing information HI is then provided to the UUV 300.

The UUV 300 is, in this example, in the form of a self-propelled remotely operated vehicle (ROV), controlled by the UMAV 200 (wirelessly or via a tether). However in alternative variations of this example and in other examples, the UUV 300 can instead be in the form of a self-propelled autonomous unmanned underwater vehicle, or in the form of a submerged gliding vehicle (optionally having no propulsion), configured for gliding to the desired location as guided by the UMAV 200 remotely, or configured for gliding to the desired location autonomously or automatically.

The UUV 300 is initially mechanically coupled to the UMAV 200, at least until it is required to operate the UUV 300 at a distance from the UMAV 200, and thus the UUV 300 is selectively releasable from the UMAV 200 when desired. For this purpose, the AMUV 200 also comprises an engagement system 290 for each one of the one or more UUV's 300. The engagement system 290 is configured for selective releasable engagement of the respective UUV 300 with respect to the AMUV 200. The engagement system 290 can be configured for one-time use only, for example comprising explosive bolts, that engage each UUV 300 with respect to the AMUV 200, and when activated disengage the respective UUV 300 from the AMUV 200 but do not allow subsequent re-engagement. Alternatively, engagement system 290 can be configured for multiple use, for example comprising suitable clamps, that when closed selectively engage each UUV 300 with respect to the AMUV 200, and when opened disengage the respective UUV 300 from the AMUV 200.

Referring again to FIG. 1, the UUV 300 comprises a hull 301, for example a pressure hull, is self-propelled, and is operatively connected to the UMAV 200 via an umbilical tether 301. Either one of the UMAV 200 or the UUV 300 comprises a tether management system to control the length of the tether 301 as the two vehicles become spaced apart from one another after disengagement. The UUV 300 includes an underwater propulsion system 310 powered by internal batteries and/or by power transmission from the UMAV 200 via a power and communications chord comprised the tether 301. The UUV 300 also includes a maneuvering capability including maneuvering units such as for example maneuvering thrusters and/or control vanes schematically illustrated at 315, and a control unit 340. The control unit 340 is configured for controlling the motion of the UUV 300, and for steering the UUV 300 to the location L of an object of interest OOI responsive to receiving the homing information HI, provided by the UMAV 200 via the tether 301.

The UUV 300 also comprises an object neutralization unit 390, which in this example is configured for neutralizing an OOI in the form of a mine. The object neutralization unit 390 can comprise a suitable explosive charge that can be preset to detonate when the UUV 300 is within a predetermined distance from the mine, for example via a proximity fuse, or can be remotely detonated from the UMAV 200 via the tether 301.

Additionally or alternatively, the object neutralization unit 390 can be configured for selective electromagnetic triggering of a mine, and for example comprises a magnetic field generator that generates a magnetic field that triggers the mine, for use with magnetic mines.

Additionally or alternatively, the object neutralization unit 390 can be configured for selective acoustic triggering of a mine, and for example comprises an acoustic sound generator that is configured for mimicking acoustic characteristics of vessels that trigger the mine, for use with mines that are triggered by such acoustic characteristics.

Additionally or alternatively, the object neutralization unit 390 can comprise manipulators and/or cutting equipment configured for tearing off or cutting an anchoring cable C in cases here the object of interest OOI is in the form of a mine suspended above the sea bed SB via such a cable C (see FIG. 3).

The UUV 300 can further comprise sensors (not shown), for example an imaging sensor for optically or sonically imaging the object of interest OOI as the UUV 300 approaches the object of interest OOI, to optionally provide verification information regarding the identification of the object of interest OOI prior to neutralization thereof.

The system 100, in particular the UMAV 200, is configured for generating verification data VD indicative of verification of neutralization of an object of interest OOI, after the UUV 300 has disengaged from the AMUV 200 and has performed its neutralization task regarding the respective OOI. For example, the UMAV 200 is configured for approach the location L wherein the object of interest OOI was located, and the sensor package 230 is configured for obtaining image data at the location, which is expected to include image data of the neutralized object of interest OOI. For example, such image data can include optical and/or acoustic images of the location L, which can be analyzed by a human operator to determine whether the object of interest OOI has been fully or partially neutralized. For this purpose, the UMAV 200 is configured for initiating a communication procedure with the central control, using the communication system 250, to transmit the image data to the central control. Alternatively, such image date is stored in the system 100, and downloaded at a later time when the system 100 returns to base.

The UMAV 200 can be further configured for receiving control commands from the central control, via the communication system 250 for example, to enable the system 100, in particular the AMUV 200 to continue with its mission. For example, if the central control verifies that the object of interest OOI was neutralized, the command information that is received by the system 100, in particular the AMUV 200, is to continue with the next stage of search, until the next object O or the next object of interest OOI is found. On the other hand if the object of interest OOI is not considered by the central control as having been neutralized, the command information that is received by the system 100, in particular the AMUV 200, can be to repeat the neutralization procedure, with the same UUV 300 if this is still functional, or with a different UUV 300, or to provide information to the control center that the system 100 has no further neutralization capability (if this is the case) so that another system 100 can be sent to continue with the neutralization procedure. Alternatively, the central control can provide control commanders for the system 100 to continue with the search, or to adopt a bottom-out mode, or to return to base, for example.

As disclosed above, the AMUV 200 is configured as an autonomous underwater vehicle, configured for operating autonomously, though the AMUV 200 an optionally be further configured for receiving instructions (for example navigation instructions) from a central control, remote from the system 100, from time to time.

By operating autonomously is meant herein that the AMUV 200 can operate independently of a human operator, autonomously performing tasks including searching for and detecting objects O, communicating with a central control remote from the system 100, and verifying neutralization of at least one object of interest OOI, and optionally including travelling to the region of interest ROI, and optionally including identifying at least one object of interest OOI from among the objects O. For the purpose of providing autonomous operation, the AMUV 200 includes predetermined control information CI, including internal control data and internal control instructions, stored in a memory of the control unit 240. The control information CI includes suitable programming for operating the system 100 and in particular the AMUV 200 according to predefined mission parameters. For example such mission parameters can include identifying the location of the region of interest ROI, and the type of object of interest OOI being searched for: in such a case the control information CI includes software for providing command instructions to the propulsion system 210 and maneuvering units 215, for obtaining location information and navigation information from the navigation system 260, and for causing the system 100 to travel to the region of interest ROI based on the obtained information.

Another mission parameter can include for example conducting a search of the region of interest ROI, and the control information CI in such a case includes software for providing command instructions to the propulsion system 210 and maneuvering units 215 for causing the system 100 to search the region of interest ROI for objects. The control information CI can also include software for choosing between a number of different generic search paths, and for calculating a nominal search path, based on this choice, adapted to the particular details of the region of interest ROI, and thus providing corresponding command instructions to the propulsion system 210 and maneuvering units 215 for causing the system 100 to search the region of interest ROI for objects O following this nominal search path.

In addition, the control information CI can further include commands for controlling the system 100, in particular the AMUV 200, under a number of events, including situations or conditions, which typically cannot be predicted in space and/or in time, but which nevertheless are recognizable by the system 100, in particular the AMUV 200. Such events can include for example an obstacle in the path of the system 100, in which case obstacle data is provided to the control unit 240 (for example via an obstacle avoidance sonar), and the control information CI generates suitable control commands for the propulsion system 210 and maneuvering units 215 to enable the system 100, in particular the AMUV 200, to perform evasive maneuvers and to thus avoid the obstacle, and to then resume its path.

Other events can include, for example, switching from a particular coarse search pattern to a local detailed search pattern at a particular location where an object O has been detected in order to provide more detailed data of the seabed or object O at that location, and the control information CI generates suitable control commands for the propulsion system 210 and maneuvering units 215 to switch between search patterns.

Another such event can include, for example, seeking identification of a detected object O, or verification of identification that a detected object is in fact an object of interest OOI, in which case the control information CI generates suitable control commands for the system 100, in particular the AMUV 200, to initiate a communication procedure with the central control, using the communication system 250, to transmit data to the central control and to receive control commands therefrom, to enable the system 100, in particular the AMUV 200 to continue with its mission. For example, if the central control identifies or verifies that a particular object O is in fact an object of interest OOI, the command information that is received by the system 100, in particular the AMUV 200, is to continue with the next stage of neutralization. On the other hand, if the object O is identified or verified as not being an object of interest OOI, the command information that is received by the system 100, in particular the AMUV 200, is to ignore the object O and to continue with or end the search.

Another such event can be the identification of an object O as an anchor AK of a mine (see FIG. 3), in which case the object of interest OOI is in practice the mine, rather than the anchor. In such a case the control information CI generates suitable control commands for the system 100, in particular the AMUV 200, to initiate a search maneuver above the location of the anchor AK to detect whether there is actually an object O (suspected mine) connected to the anchor AK via a cable. For example, if another object is detected above the anchor, the control information CI generates suitable control commands to identify the object O, and if identified as an object of interest OOI, i.e., a mine, further control commands are generated for the system 100 to continue with the next stage of neutralization; whereas if the object is identified or verified as not being an object of interest OOI, the command information generated to autonomously operate the system 100, in particular the AMUV 200, is to continue with the search for other objects in the region of interest ROI or to end the search, for example.

Another such event can include providing verification of neutralization of an object of interest, after the UUV 300 has disengaged from the AMUV 200 and has performed its neutralization task regarding the respective OOI. In such a case, the control information CI generates suitable control commands for the propulsion system 210 and maneuvering units 215 to approach the location L where in the object of interest OOI was located, and to operate the sensor package 230 to obtain image data at the location. The control information CI then generates suitable control commands for the system 100, in particular the AMUV 200, to initiate a communication procedure with the central control, using the communication system 250, to transmit the image data to the central control and to receive control commands therefrom, to enable the system 100, in particular the AMUV 200 to continue with its mission. For example, if the central control verifies that the object of interest OOI was neutralized, the command information that is received by the system 100, in particular the AMUV 200, is to continue with the next stage of search. On the other hand if the object of interest OOI is not considered by the central control as having been neutralized, the command information that is received by the system 100, in particular the AMUV 200, can be to repeat the neutralization procedure, with the same UUV 300 is still functional, or with a different UUV, or to continue with the search, or to adopt a bottom-out mode, or to return to base, for example.

Another such event can include the detection of hostile forces in the vicinity of the system 100 which could provide a clear and present danger thereto. The actuality of such an event can be transmitted to the AMUV 200 from the central control, or can be determined by the system 100, or can be programmed into the control unit 240 (for example, it is expected that an enemy patrol ship patrols the region of interest ROI at certain times of the day). In such a case, the control information CI generates suitable control commands for the propulsion system 210 and/or maneuvering units 215 and/or the ballast system 270 to cause the AMUV 200 to bottom out, i.e., to land on the sea bed and adopt a quiet mode, i.e., generating no noise or an absolute minimum of noise or movement. The control information CI can then generate suitable control commands after a period of time for the system 100, in particular the AMUV 200, to continue with its mission, when it is considered, deemed or verified that the danger has passed.

The system 100 can be operated in a number of ways, for example as follows.

In one operating mode, the control unit 240 can be programmed with a mission at a particular ROI, for example a search and neutralization mission (SNM) for mines at the ROI. Alternatively, the particular mission can be provided to the system 100 via the communication system 250.

If the system 100 is not already at the ROI, the control unit 240 autonomously navigates the system 100 to the ROI, for example as disclosed above. The SNM can start immediately, or alternatively, the system 100 can assume a bottom out mode, and rest on the sea bed at minimal power consumption until the SNM commences. For example, the ROI can include the entrance to an enemy target which is mined to protect the target from a seaborne assault. If for example it is desired to assault the target on a particular date, the system 100 can be programmed to start the SNM a period of time before this date, this period being sufficient to allow the system 100 to search the whole ROI thoroughly and neutralize any mines that can be found there just prior to the assault, and thus minimize the chances of the enemy redeploying mines in the ROI.

Alternatively, for example, the ROI can be a friendly installation that needs to be kept clear of enemy mines, and the system 100 can be programmed to clear the ROI of mines at least just prior to friendly shipping being scheduled to come into the ROI, and thus minimize the risk of new enemy mines being redeployed.

If the ROI is particularly large and would take the system 100 too long to search, or if it is suspected that the ROI has a large density of mines and would take too long to neutralize, the ROI can be effectively divided into a plurality of smaller ROI's, each of which can have a different system 100 assigned thereto.

When the SNM commences, the system 100, in particular the AMUV 200 autonomously searches the respective ROI according to a search pattern that ensures that the whole ROI is covered, for example as disclosed above. During such searching, the sensor package 230 scans the ROI and detects objects O that could potentially be objects of interest OOI, and for each such object O the system 100 generates detection information DI, which includes information that indicates that an object O has been detected at a particular location L, and in at least some examples the detection information DI relates to at least one characteristic M of these objects O, for example as disclosed above.

In some examples, the system 100 autonomously processes the detection information DI to identify any OOI among the objects O, for example as disclosed herein, and thereafter proceeds to the neutralization step. Alternatively, prior to the neutralization step, the system 100 transmits the detection information relating to the identified OOI to a central control (remote from the system 100) for verification that the respective object O is indeed an OOI, and when confirmation is received by the system 100, the system 100 then proceeds to the neutralization step.

In other examples, the detection information DI of each object O is sent to the central control, which analyses the data and identifies which of the objects O is an OOI, and then transmits to the system 100 the location data of the identified OOI, after which the system 100 can proceed with the neutralization step.

In the neutralization step, the system 100, in particular the AMUV 200, provides homing information to the UUV 300 regarding the location of the OOI. The system 100 transports the UUV 300 to within a predetermined distance from the location and then disengages the UUV 300 from the AMUV 200. The predetermined distance is chosen to enable the UUV 300 to reach the OOI in a self propelled manner, and to neutralize the OOI independently of the AMUV 200; the predetermined distance is also chosen to allow the AMUV 200 to be kept at a safe distance from the OOI and thus not become damaged when the OOI is neutralized in a destructive manner, for example by detonation. When disengaged from the AMUV 200, the UUV 300 is guided to the location L via the homing data, and the UUV 300 can optionally provide image data of the location L to the AMUV 200 prior to neutralization of the OOI. This image data can serve to verify that the UUV 300 correctly positioned itself proximate to the OOI, for example, or can be used by the AMUV 200 to further verify that the UUV 300 is in the correct position.

Then, the UUV 300 neutralizes the OOI, for example as disclosed above.

In the subsequent verification step, the AMUV 200 can approach the location L and obtain image data thereof that should show whether the OOI has been partially or fully destroyed, or whether the OOI is undamaged, and thus such image data can be used for verification of neutralization of the OOI. Thus, for example, such image data can be transmitted (optionally with the image data provided by the UUV 300 prior to neutralization) to the central control.

The central control can then instruct the system 100 to attempt again to neutralize the OOI if undamaged (for example, by using another UUV 300 carried by the AMUV 200), or to proceed to the next OOI; alternatively, the system 100 is configured for autonomously proceeding in this manner.

In a variation of such a method, for example in examples of the system 100 in which the UUV 300 is not self propelled, in the neutralization step the AMUV 200 carries the respective UUV 300 to the desired proximity to the OOI required for its neutralization, and then the AMUV retires to a safe distance from the UUV 300 prior to detonation of the OOI.

It is therefore appreciated that the system 100 can be operated covertly, and furthermore allows neutralization of mines without the need to endanger personnel.

In the method claims that follow, alphanumeric characters and Roman numerals used to designate claim steps are provided for convenience only and do not necessarily imply any particular order of performing the steps.

It should be noted that the word "comprising" as used throughout the appended claims is to be interpreted to mean "included but not limited to".

Whilst some particular embodiments have been described and illustrated with reference to some particular drawings, the artisan will appreciate that many variations are possible which do not depart from the general scope of the presently disclosed subject matter, mutatis mutandis.

The invention claimed is:

1. A system for underwater use, comprising:

an autonomous mother unmanned underwater vehicle (AMUV) and at least one auxiliary unmanned underwater vehicle (UUV), the AMUV being configured for autonomously searching for and detecting undersea objects potentially present in an undersea region of interest (ROI), for generating object information relating to the objects detected thereby to enable identification of at least one object of interest (OOI) among the detected objects, and for selectively transporting said at least one UUV to at least within a predetermined distance from a location of said at least one OOI;

said at least one UUV being configured for interacting with said at least one OOI at least within said predetermined distance;

the system being further configured for providing verification information indicative of said interaction between said at least one UUV and said OOI;

wherein said AMUV comprises a communications system at least configured for transmitting said verification information.

2. System according to claim 1, including at least one of the following:

wherein the OOI is a mine and wherein said interaction comprises neutralizing the mine, and wherein said neutralization comprises destroying the mine; and wherein the OOI is a mine and wherein said interaction comprises neutralizing the mine, and wherein said neutralization comprises causing the mine to detonate.

3. System according to claim 1, wherein said AMUV is configured for autonomously identifying at least one said OOI among the detected objects in said ROI by processing said object information.

4. System according to claim 3, including at least one of the following:

wherein said processing of said object information comprises comparing a geometrical form of the respective object with a geometrical forms corresponding to the OOI;

wherein said processing of said object information comprises comparing a geometrical form of the respective object with a geometrical forms corresponding to the OOI, and wherein said AMUV comprises imaging sensors configured for providing image data representative of said geometrical form of the respective object; and wherein said processing of said object information comprises comparing a geometrical form of the respective object with a geometrical forms corresponding to the OOI, and wherein said AMUV comprises imaging sensors configured for providing image data representative of said geometrical form of the respective object, and wherein said imaging sensor include at least one of optical sensors and acoustic sensors.

5. System according to claim 1, wherein said AMUV comprises a propulsion system, a maneuvering system and a navigation system coupled to a control unit for enable autonomous operation of said AMUV.

6. System according to claim 1, including at least one of the following:

wherein said transmitted object information is processed remotely from said system, and wherein said communication system is configured for receiving control information verifying that a respective said object has been identified by the AMUV is OOI; and wherein said transmitted object information is processed remotely from said system, and wherein said communication system is configured for receiving control information indicative that a respective said object has been identified remotely as being an OOI.

7. System according to claim 1, wherein said communication system comprises an antenna that is selectively deployable above the water surface for operation above the water surface while the AMUV is submerged.

8. System according to claim 1, including at least one of the following:

wherein said communication system is configured for transmitting and receiving data using at least one of the following types of communication:

cellular communication systems;

satellite telephone communication systems; and satellite communication systems using broadband; and wherein said system is configured for selectively engaging said at least one UUV to said AMUV at least while being transported by said AMUV, and for selectively disengaging said at least one UUV from said AMUV within said predetermined distance from the OOI.

9. System according to claim 1, including at least one of the following:

wherein said at least one UUV is a self-propelled remotely operated vehicle and is controlled by said AMUV;

wherein said at least one UUV is a self-propelled remotely operated vehicle and is controlled by said AMUV, and wherein said at least one UUV is connected to said AMUV via an umbilical tether;

wherein said at least one UUV is a self-propelled autonomous vehicle and is configured for operating autonomously at least when interacting with said at least one OOI within said predetermined distance;

wherein said at least one UUV is a non-self-propelled vehicle and is configured for being deposited within said predetermined distance at least when interacting with said at least one OOI; and wherein said AMUV is configured for autonomously travelling to the ROI from a starting point remote from said ROI.

10. System according to claim 1, wherein said at least one UUV comprises an explosive charge configured for being selectively detonated in a manner to neutralize the respective OOI.

11. System according to claim 1, wherein said AMUV is configured for autonomously detecting said undersea objects present in an undersea region of interest, by providing detection information for each detected said object relating to a characteristic of said objects.

12. System according to claim 1, wherein said AMUV is configured for providing homing information regarding said location of a respective OOI to said at least one UUV, and wherein said at least one UUV is configured for homing onto said location based on said homing information.

13. System according to claim 1, including at least one of the following:

wherein said AMUV comprises a ballast system configured for selectively enabling the system to bottom out;

wherein said AMUV comprises a ballast system configured for selectively and repeatably enabling the system to bottom out; and wherein said control unit is configured for causing the system to bottom out for a predefined period.

14. A system for underwater use, comprising:

an autonomous mother unmanned underwater vehicle (AMUV), configured for autonomously searching for and detecting undersea objects present in an undersea region of interest, for providing detection information for each detected said object relating to a characteristic of said objects, and for providing homing information regarding a respective location of at least one object of interest (OOI) among said objects;

at least one auxiliary unmanned underwater vehicle (UUV) configured for homing onto and neutralizing said at least one OOI based on said homing information;

wherein said system is configured:

for providing said homing information from the AMUV to a respective said UUV, for selectively transporting the respective said UUV via said AMUV, and for selectively releasing the respective UUV from the AMUV when said OOI has been identified, to selectively allow the UUV to home onto and neutralize said at least one OOI; and for subsequently providing verification information indicative that said OOI has been neutralized;

wherein said AMUV comprises a communications system for communicating with a central control and configured for sending and/or receiving signals or data above the water surface, for at least one of:

transmitting said verification information;

transmitting object information relating to said objects to the central control.

15. The system according to claim 14, wherein the communication system is configured for transmitting said verification information, and wherein said AMUV is further configured for autonomously identifying said OOI according to predetermined criteria.

16. The system according to claim 14, wherein transmitting said object information to the central control enables the central control to identify said OOI or to confirm identification of said OOI by said AMUV according to predetermined criteria.

17. A method for underwater use, comprising:

(a) providing an autonomous mother unmanned underwater vehicle (AMUV) and at least one auxiliary unmanned underwater vehicle (UUV);

(b) operating the AMUV for autonomously searching for and detecting undersea objects potentially present in an undersea region of interest (ROI);

(c) identifying at least one object of interest (OOI) among the detected objects, and selectively transporting said at least one UUV to at least within a predetermined distance from a location of said at least one OOI;

(d) causing said at least one UUV to interact with said at least one OOI at least within said predetermined distance;

(e) providing verification information indicative of said interaction between said at least one UUV and said OOI;

(f) transmitting at least one of said verification information and said object information.

18. The method according to claim 17, including at least one of the following:

wherein the OOI is a mine and wherein said interaction comprises neutralizing the mine; and wherein said neutralization comprises destroying the mine or causing the mine to detonate.

19. The method according to claim 17, including at least one of the following:

wherein said AMUV autonomously identifies at least one said OOI among the detected objects in said ROI by processing said object information; and wherein said AMUV autonomously identifies at least one said OOI among the detected objects in said ROI by processing said object information, and, wherein said processing of said object information comprises comparing a geometrical form of the respective object with a geometrical forms corresponding to the OOI;

wherein said AMUV autonomously identifies at least one said OOI among the detected objects in said ROI by processing said object information, and, wherein said processing of said object information comprises comparing a geometrical form of the respective object with a geometrical forms corresponding to the OOI, and, wherein said geometrical form of the respective object is provided by image data of the respective object; and wherein said AMUV autonomously identifies at least one said OOI among the detected objects in said ROI by processing said object information, and, wherein said processing of said object information comprises comparing a geometrical form of the respective object with a geometrical forms corresponding to the OOI, and, wherein said geometrical form of the respective object is provided by image data of the respective object, and, wherein said imaging data includes at least one of optical image data and acoustic data.

20. The method according to claim 17, including at least one of the following:

comprising the step of processing said transmitted object information remotely from said AMUV, and the step of receiving control information verifying that a respective said object that has been identified by the AMUV is OOI;

comprising the step of processing said transmitted object information remotely from said AMUV, and comprising the step of receiving control information by the AMUV indicative that a respective said object has been identified remotely as being an OOI;

wherein said verification information comprises imaging data of the respective said location subsequent to said interaction with the respective said OOI;

comprising causing the AMUV to selectively deploy an antenna above the water surface for operation above the water surface to transmit at least one of said verification information and said object information while the AMUV is submerged;

comprising causing the AMUV to selectively deploy an antenna above the water surface for operation above the water surface to transmit at least one of said verification information and said object information while the AMUV is submerged, and, comprising transmitting and receiving data using said antenna via at least one of the following types of communication:

cellular communication systems;

satellite telephone communication systems; and satellite communication systems using broadband;

comprising selectively engaging said at least one UUV to said AMUV at least while being transported by said AMUV, and selectively disengaging said at least one UUV from said AMUV within said predetermined distance from the OOI; and comprising remotely operating said at least one UUV by said AMUV or autonomously operating said at least one UUV at least when interacting with said at least one OOI within said predetermined distance.

21. The method according to claim 17, comprising causing the AMUV to selectively deploy an antenna above the water surface for operation above the water surface to transmit at least one of said verification information and said object information while the AMUV is submerged, and including at least one of the following:

comprising causing the AMUV to autonomously travel to the ROI from a starting point remote from said ROI, while the at least one UUV is engaged to the AMUV;

comprising autonomously detecting said undersea objects present in an undersea region of interest, via the AMUV, by providing detection information for each detected said object relating to a characteristic of said objects;

comprising providing homing information regarding said location of a respective OOI to said at least one UUV by the AMUV, and causing said at least one UUV to home onto said location based on said homing information;

comprising selectively causing the AMUV to bottom out;

comprising selectively causing the AMUV to bottom out repeatedly; and comprising selectively causing the AMUV to bottom out for a predefined period.

22. The system according to claim 1, wherein said verification information comprises imaging data of the respective said location subsequent to said interaction with the respective said OOI.

23. The system according to claim 1, wherein said AMUV is configured for approaching said location, said AMUV comprising a sensor package configured for obtaining image data at the respective said location subsequent to said interaction with the respective said OOI to thereby provide said verification data.

24. A system for underwater use, comprising:

an autonomous mother unmanned underwater vehicle (AMUV) and at least one auxiliary unmanned underwater vehicle (UUV), the AMUV being configured for autonomously searching for and detecting undersea objects potentially present in an undersea region of interest (ROI), for generating object information relating to the objects detected thereby to enable identification of at least one object of interest (OOI) among the detected objects, and for selectively transporting said at least one UUV to at least within a predetermined distance from a location of said at least one OOI;

said at least one UUV being configured for interacting with said at least one OOI at least within said predetermined distance;

the system being further configured for providing verification information indicative of said interaction between said at least one UUV and said OOI;

wherein said AMUV comprises a communications system at least configured for transmitting said verification information; and wherein the OOI is a mine and wherein said interaction comprises neutralizing the mine.

* * * * *